United States Patent [19]

Carlisle

[11] Patent Number: 4,685,665

[45] Date of Patent: Aug. 11, 1987

[54] HAND EXERCISING DEVICE

[76] Inventor: Richard S. Carlisle, Box 307, Rye, N.Y. 10580

[21] Appl. No.: 833,416

[22] Filed: Feb. 20, 1986

Related U.S. Application Data

[63] Continuation of Ser. No. 624,125, Jun. 25, 1984, abandoned.

[51] Int. Cl.[4] ..... A63B 5/00; A63B 21/00

[52] U.S. Cl. ..... 272/67; 272/130

[58] Field of Search ..... 272/67, 68, 96, 130, 272/99, 70; 446/220, 224, 267; 5/441, 442, 455; D21/198; 297/DIG. 3; D15/66, 84; 128/68, 69

[56] References Cited

U.S. PATENT DOCUMENTS 1,795,304 3/1931 Howard ..... 272/130
3,987,506 10/1976 Markwitz ..... 272/130
4,146,222 3/1979 Hribar ..... 272/70

FOREIGN PATENT DOCUMENTS 1432259 4/1976 United Kingdom ..... 272/130
1541170 2/1979 United Kingdom ..... 272/130

*Primary Examiner*—Richard J. Apley
*Assistant Examiner*—S. R. Crow

[57] ABSTRACT

A dual-chamber hand exerciser is constructed of thermoplastic sheet material. Two chambers provide means for exercising both of the user's hands. The chambers are squeezed alternately, shifting fluid back and forth from one chamber to the other, through a narrow passageway. The passageway is offset from the center of the device, to allow regulation of resistance to the fluid flow. The resistance regulation is accomplished by deflecting the chambers out of alignment with the longitudinal axis of the device. The regulation can be performed gradually or abruptly, at the same time the device is being used in the exercising process.

The method of manufacturing may include heat-stamping sheets of thermoplastic material, or, alternately, a tube of thermoplastic material, to avoid formation of heat seals along the sides of the chambers, and thus provide a smoother gripping surface.

10 Claims, 4 Drawing Figures

FIG. 1
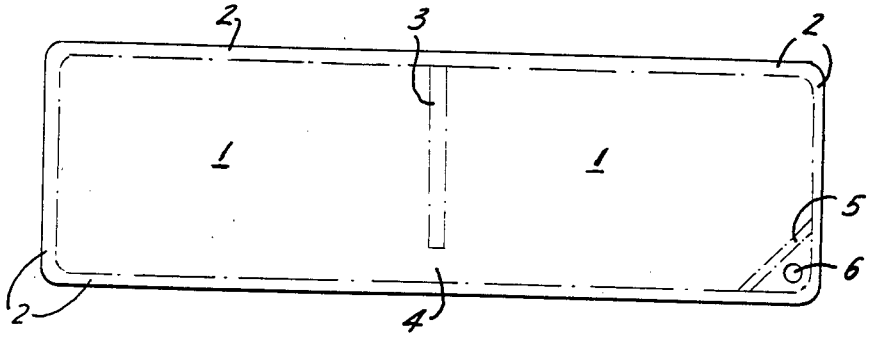
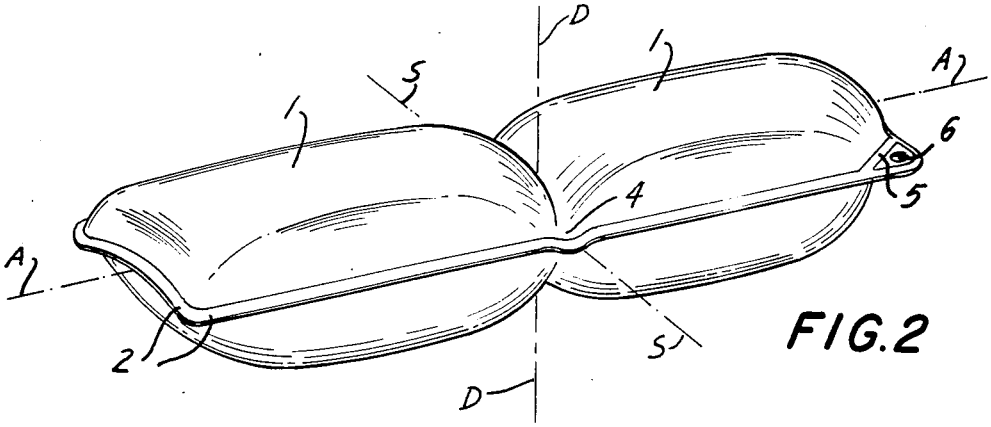
FIG. 2
FIG. 3
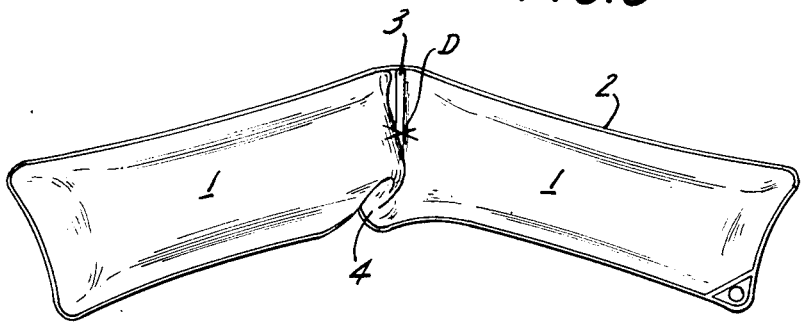
FIG. 4
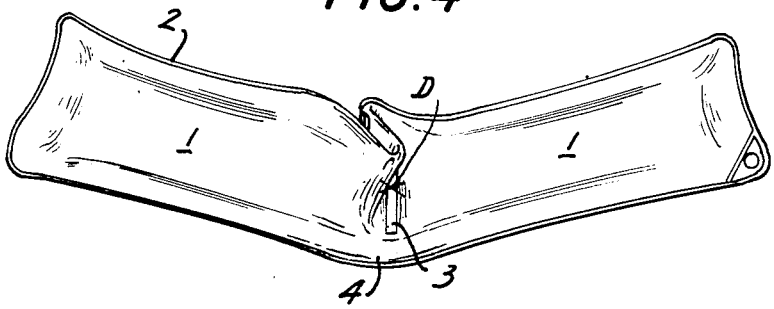

HAND EXERCISING DEVICE

This application is a continuation of application Ser. No. 06/624,125 filed June 25, 1984 abandoned.

This invention relates to hand exercising devices.

The invention has two fluid-filled chambers which communicate through a passageway, arranged to enable the user to vary the squeeze-resistance of the fluid-filled chambers.

The main object of the invention is to provide a hand exercising device which can be easily regulated with regard to resistance to squeezing while it is being used.

Further objects and advantages of the invention will become apparent from the following description and the drawiings that accompany it.

FIG. 1 is a view of the device in its flat condition before it is inflated with air or another fluid.

FIG. 2 is a perspective view of the inflated device undistorted by any externally applied force.

FIG. 3 shows the device deflected in a manner which increases resistance to fluid through the passageway.

FIG. 4 shows the device deflected so as to decrease resistance to the passage of fluid.

Referring to FIG. 1, the device 1, is shown flat before filling with a fluid substance (air, water, etc.). Continuous peripheral heat seal 2 unites two layers of pliable thermoplastic sheet material, for example, 20-mil. polyvinyl chloride. In a successful example, the sheet material has a softness quality equivalent to a durometer rating of 45–60. A method for testing the material for softness consists of taking a strip one inch wide and one foot long, and suspending it vertically with a one pound weight attached to the extreme bottom end, at seventy degrees fahrenheit ambient temperature. The entire one foot length is subjected to the one pound force. In this example, a test strip of suitably pliable material became elongated to 12¼" to 12½" after one minute under load.

Transverse heat seal 3 divides the device into two chambers of equal length. Heat seal 3 starts at heat seal 2 at one side of the device and is interrupted at a point spaced from heat seal 2 at the opposite side of the device. The adjacent region where the two films remain unsealed forms passageway 4. In a device 1 that is 12 inches long and 2 5/16 inches wide, the length of partition heat seal 3 empirically is at least four times the width of passageway 4. In an example, partition seal 3 is 2 inches long, and passageway 4 is 5/16".

Diagonal heat seal 5 forms a reinforced triangular area in which hole 6 is formed, to provide means for hanging up the device when not in use.

FIG. 2 shows the device filled with a fluid, such as air (or water, etc.). Shown are the longitudinal axis A, transverse axis S, and perpendicular transverse axis D. The two chambers are in normal longitudinal alignment, in the absence of distorting external forces.

FIG. 3 shows the device while in use, and being deflected (with axis D as a pivot) to cause restriction of passageway 4.

FIG. 4 shows the device being deflected oppositely while in use, to reduce restriction of passageway 4.

To operate the device, the user grasps a chamber with each hand and squeezes alternately to shift the fluid back and forth. The function of the device can be modified at will while it is in use. A normal, intermediate squeeze-resistance exists when the chambers are in alignment, as represented in FIG. 2. The squeezeresistance can be increased or decreased by deflecting the chambers variably out of alignment and in opposite directions as represented in FIGS. 3 and 4. The level of resistance may be changed gradually, and depends on the exact angle of deflection. Thus, the resistance level is progressively adjustable over a range of infinite values.

The chambers may be filled with an appropriate quantity of air ( or liquid, etc.) by the user through a valve (not shown), or they may be pre-filled by the manufacturer. For therapeutic use, it is preferable to provide the exerciser prefilled to a standardized pressure, due to a possible lack of ability or judgement on the part of the patient, to fill it properly.

Testing of the device in hospitals has indicated that the optimal application for the exerciser was for post-fracture patients. The device provided the easiest, most pleasant form of exercise when compared to eight other exercise products currently available. Patients recovered strength and returned to normal activities with surprising speed. A distinct advantage in exercising both hands with one device is that the strong hand "leads" the weak, thus stimulating it to higher levels of activity. The additional feature of easy resistance adjustment makes the device more interesting and effective than alternative products.

The foregoing represents an illustrative embodiment of the invention in its various aspects. Device 1 is formed of two sheets of material, peripherally heat-sealed together. As an alternative, a length of tubing could be used, heatsealed acrosss its ends. It is understood that the described device may be modified variously in other respects by those skilled in the art. Consequently the invention should be contrued broadly in accordance with its true spirit and scope.

I claim:

1. A hand-exercising device comprising first and second chamber means adapted to contain and be distended by fluid and proportioned to be grasped and alternately squeezed by the hands of the user, and connecting means physically connecting said chamber means to each other, said first chamber means and said connecting means and said second chamber means being disposed in the order named along a first direction, said connecting means having at least first and second portions spaced apart along a second direction transverse to said first direction, said first and second portions being the most widely spaced-apart portions of the connecting means, said hand-exercising device incorporating passage means for fluid transfer between said chamber means, said passage means being the entire means for fluid transfer between said chamber means, said passage means being essentially contiguous to said first portion and being effectively nearer to said first portion than to said second portion of the connecting means, said chamber means and said passage means and said connecting means being related to each other such that, when said chamber means are distended by fluid, said passage means tends to become either relatively open or constricted in response to angular shifting of one of said chamber means in relation to the other about an axis extending in a third direction orthogonally related to said first and second directions.

2. A hand-exercising device as in claim 1, formed of two sheets of thermoplastic material joined together by a peripheral seal extending continuously along opposite margins and around opposite ends of the device and by a medial seal extending from one of said opposite margins incompletely toward but not to the other of said opposite margins, said sheets of thermoplastic material joined together as aforesaid constituting said chamber means and said connecting portions of the device and said passage means, the latter being constituted between said medial seal and said other of said opposite margins.

3. A hand-exercising device as in claim 1, wherein said device is rectangular when not distended by fluid and accordingly has opposite first and second sides and opposite ends, said device being formed of sheet material that is continuously unitary along said opposite sides and ends, thereby to form first and second side margins and opposite end margins of said chamber means, said sheet material having transverse seal means extending along said second direction from said first side margin of said device toward but not to said second side margin thereof and said transverse seal means being disposed to constitute respective proximal ends of said first and second chamber means, said sheet material constituting said chamber connecting means and additionally constituting said passage means, the latter being located between said transverse seal means and said second side margin.

4. A hand-exercising device as in claim 3, wherein said sheet material comprises opposite sheets of thermoplastic material continuously sealed to each other along said side margins of said end margins and said transverse seal means.

5. A hand-exercising device as in claim 1, wherein each of said chamber means has opposite first and second side margins essentially aligned with the opposite first and second side margins, respectively, of the other of said chamber means when the device is not grasped and thus stressed, said device being formed of sheet material constituting opposite chamber walls, said opposite walls being joined together along a common seal that delineates proximal ends of the chambers, the common seal extending from the first said margins of said chambers toward, but not to, the second side margins of the first and second chamber means, the region of said sheet material between the common seal and said second side margins constituting said passage means.

6. A hand-exercising device as in claim 1, wherein each of said chambers is elongated along said first direction.

7. A hand-exercising device as in claim 2, wherein each of said chambers is elongated along said first direction.

8. A hand-exercising device as in claim 3, wherein each of said chambers is elongated along said first direction.

9. A hand-exercising device as in claim 5, wherein each of said chambers is elongated along said first direction.

10. A hand-exercising device as in claim 1 wherein said passage means is relatively far from said second portion of the connecting means.

* * * * *